US005915683A

United States Patent [19]

Otsuka

[11] Patent Number: 5,915,683

[45] Date of Patent: Jun. 29, 1999

[54] AIR SUCTION TYPE PAPER FEEDING DEVICE

[75] Inventor: Masao Otsuka, Osaka, Japan

[73] Assignee: Mita Industrial Co., Ltd., Osaka, Japan

[21] Appl. No.: 09/025,091

[22] Filed: Feb. 17, 1998

[30] Foreign Application Priority Data

Feb. 17, 1997 [JP] Japan ..... 9-049690
Feb. 17, 1997 [JP] Japan ..... 9-049691
Feb. 17, 1997 [JP] Japan ..... 9-049692

[51] Int. Cl.[6] ..... B65H 3/12; B65H 1/08; B65H 3/34; B65H 3/36

[52] U.S. Cl. ..... 271/94; 271/30.1; 271/104; 271/105

[58] Field of Search ..... 271/96, 98, 104 C, 271/94, 161, 167, 105, 108, 123, 30.1

[56] References Cited

U.S. PATENT DOCUMENTS 4,595,190 6/1986 Amarakoon ..... 271/94
5,181,706 1/1993 Yamamoto ..... 271/98 X

FOREIGN PATENT DOCUMENTS 63-185747 8/1988 Japan ..... 271/161
6-199437 7/1994 Japan ..... 271/98

*Primary Examiner*—William E. Terrell
*Assistant Examiner*—Kenneth Bower
*Attorney, Agent, or Firm*—Shinjyu An Intellectual Property Firm

[57] ABSTRACT

The present invention relates to an air suction type paper feeding device that includes at least one rib 5 formed on a paper supply table, the rib slightly lifting papers P such that the bottommost paper is less likely to be retained by static electricity. The invention also relates to a jogging plate disposed at a rear end of the paper supply table which has an inclined portion which urges the uppermost papers on the paper supply table towards an air supply means. The jogging plate is further formed with an arcuate portion which diverts air from the air supply means downward against a rear end portion of the paper on the paper supply table. The present invention further relates to a paper feeding belt 3 having air permeability disposed above stacked papers on the paper supply table. A vacuum manifold is disposed between portions of the feeding belt 3 to provide vacuum to lift papers. The vacuum manifold is formed with a plurality of suction ports a, b, c. The suction ports a, b are provided with movable covers 11 which allow for selective opening and closing of those suction ports in response to the size paper on the paper supply table.

10 Claims, 17 Drawing Sheets

AIR SUCTION TYPE PAPER FEEDING DEVICE

BACKGROUND OF THE INVENTION

A. Field of the Invention

The present invention relates to a paper feeding device that uses air suction for manipulation of paper in an image forming apparatus, such as electrostatographic copying machines, facsimiles, printers and the like.

B. Description of Related Art

There are paper feeding device which uses air suction in which airflow is applied to stacked papers to lift and separate the papers from one another, and an uppermost paper of the stacked papers drawn away and transferred by vacuum from a vacuum device.

Such devices are characterized in that a groove for introducing airflow is provided in an end portion opposite to a nozzle disposed on a bottom plate of a tray on which papers are stacked. Even for a small amount of remaining papers, airflow from the nozzle is introduced into the groove to lift the end of papers, so as to ensure the vacuum and transfer of an uppermost paper.

In the device described above, however, the groove is provided only in the end portion of the bottom plate of the tray, and the area of contact between a final paper and the bottom plate is large. Therefore, when strong static forces due to, for instance, static electricity are present, the final paper may resist lifting even if air flow is present into the groove.

Further, regardless of the type of paper, or thickness of paper in the device, the air flow through the groove is generally constant. Since thin papers are light, they may be lifted too forcefully and since thick papers are heavy, they might not be lifted at all. Thus, it is difficult to determine an appropriate amount of vacuum pressure to create an appropriate flow of air to move paper.

There is also a paper feeding device which includes a pressure foot member structurally free to move up and down between a paper transferring belt and an uppermost paper in a stack of papers. The pressure foot member may selectively supply airflow from a front portion thereof to expand the air between an uppermost paper and an underlying paper, so as to produce reliable separation of the two papers.

When a pressure foot member is provided, it is necessary to provide a plate for contacting the rear end of paper, where the plate is adjustable back and forth. Space is limited in such devices and thus reducing the degrees of freedom of design. Further, the overall number of parts increases, resulting in higher cost.

SUMMARY OF THE INVENTION

In view of the disadvantages as described, one object of the present invention is to provide an air suction type paper feeding device that securely lifts papers, irrespective of paper thickness.

Another object of the present invention is to provide an air suction type paper feeding device which retains the rear end of stacked paper and also holds the stacked paper down, with a simple structure.

In accordance with one aspect of the present invention, a vacuum paper feeding device for supplying paper to image forming apparatus includes a paper supply table configured to be raised in response to paper consumption. A blowing means blows air toward a front end of papers stacked on the paper supply table and a vacuum source and corresponding air permeable belts move and transfer an uppermost one of the stacked paper. Further, the paper supply table includes at least one rib formed which extends along an upper surface thereof for slightly lifting the stacked papers. The rib is configured to allow air from the blowing means to flow between a bottom paper of the stacked paper and the upper surface of the paper supply table with the paper supply table in an upper position.

Preferably, the paper supply table has a front end and a rear end and the blowing means blows air from a front end of papers staked on the paper supply table toward a rear end of the stacked papers. A rear end urging plate extends above an upper surface of the paper supply table proximate the rear end thereof. The urging plate has an upper end having an inclined portion configured for engagement with the stacked papers urging the uppermost of the stacked papers toward the front end of the paper supply table. The urging plate is further formed with a curved portion which arcs from the inclined portion toward the stacked papers. Air flow from the blowing means is directed by the inclined portion and the curved portion down toward an uppermost paper of the stacked papers in order to prevent further papers of the stacked papers from moving with movement of the uppermost paper.

Preferably, the belts extend around a portion of the vacuum source. The vacuum source includes a manifold having a plurality of suction ports. At least one of the suction ports has a corresponding cover disposed within the manifold. The cover has a column extending downward from the cover through the suction port, the cover covering the suction port. The column is configured for engagement with the stacked paper and in response to engagement with the stacked paper, the column lifts the cover to open the suction port.

In another aspect of the present invention a vacuum paper feeding device for image forming apparatus includes a paper supply table configured to be raised in response to paper consumption, the paper supply table having a front end and a rear end. A blowing means blows air from a front end of papers staked on the paper supply table toward a rear end of the stacked papers. A vacuum source and corresponding air permeable belts move and transfer an uppermost one of the stacked paper. A rear end urging plate extends above an upper surface of the paper supply table proximate the rear end thereof. The urging plate has an upper end having an inclined portion configured for engagement with the stacked papers urging the uppermost of the stacked papers toward the front end of the paper supply table. The urging plate is further formed with a curved portion which arcs from the inclined portion toward the stacked papers. Air flow from the blowing means is directed by the inclined portion and the curved portion down toward an uppermost paper of the stacked papers in order to prevent further papers of the stacked papers from moving with movement of the uppermost paper.

In accordance with another aspect of the present invention, a vacuum paper feeding device for image forming apparatus includes a paper supply table configured to be raised in response to paper consumption, the paper supply table having a front end and a rear end. A blowing means blows air from a front end of papers staked on the paper supply table toward a rear end of the stacked papers. A vacuum source and corresponding air permeable belts move and transfer an uppermost one of the stacked papers. The belts extend around a portion of the vacuum source. The vacuum source includes a manifold having a plurality of suction ports, at least one of the suction ports having a corresponding cover disposed within the manifold. The cover has a column extending downward from the cover through the suction port. The cover covers the suction port and the column is configured to engage the stacked paper and in response to engagement with the stacked paper, the column lifts the cover to open the suction port.

Preferably, the manifold further includes at least two groups of suction ports, a first group of suction ports being open and a second group of suction ports, each being provided with a corresponding one of the cover.

In one aspect above, since papers are lifted by the rib, even for thin papers, the contact area with the surface of the supply table is reduced and less subject to the influence of static electricity.

The ribs lift large thickness papers as well, an due to the stiffness of such thick papers, a larger space is defined between the surface of the table and the underside of the paper. Therefore, a large amount of air can get between the paper and the surface.

As a result of the above described covers of the present invention, only those suction ports that are needed are open to provide vacuum for lifting a sheet of paper. The power provided to a vacuum pump can be reduced since less vacuum pressure is necessary.

These and other objects, features, aspects and advantages of the present invention will become more fully apparent from the following detailed description of the present invention when taken in conjunction with the accompanying drawings where like reference numerals denote corresponding parts throughout.

DESCRIPTION OF THE PREFERRED EMBODIMENTS

First Embodiment

Figure 1:
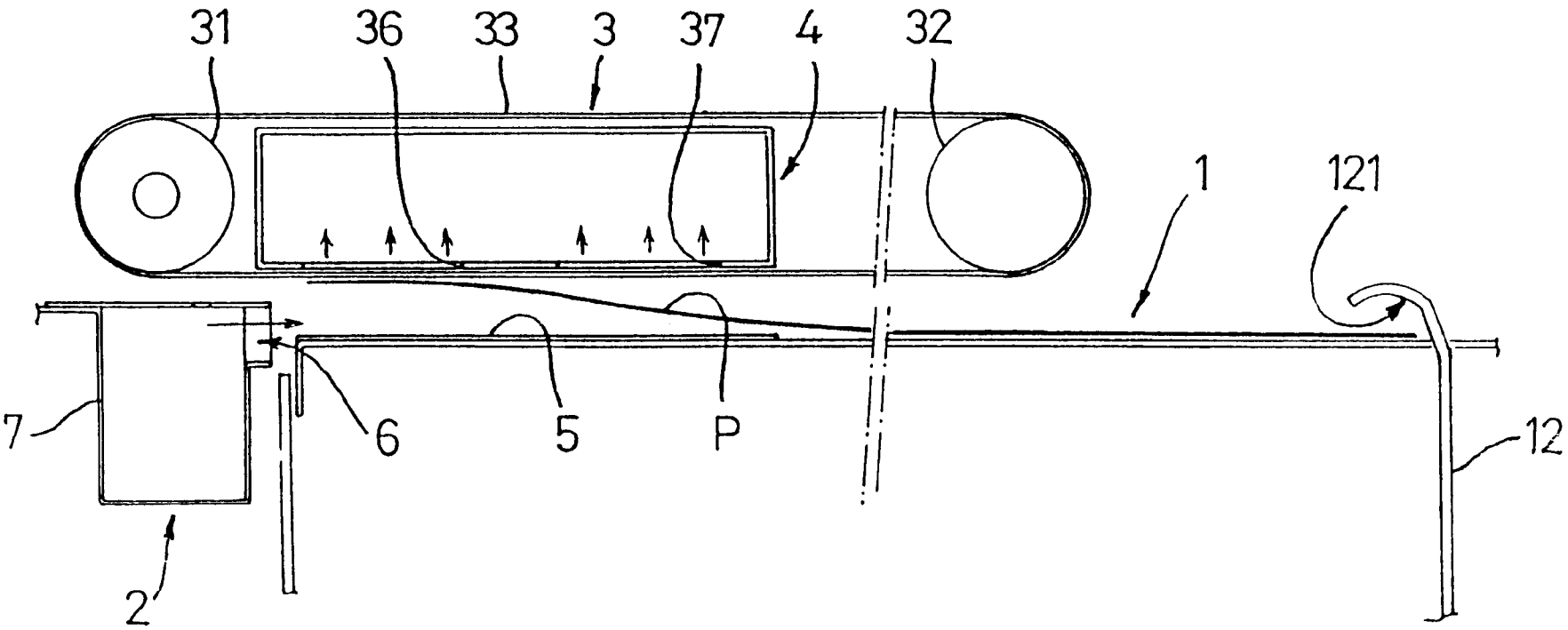
FIG. 1 is a schematic side cross sectional view of an air suction type paper feeding device used with a paper supply table in accordance with a first embodiment of the present invention.
Figure 2:
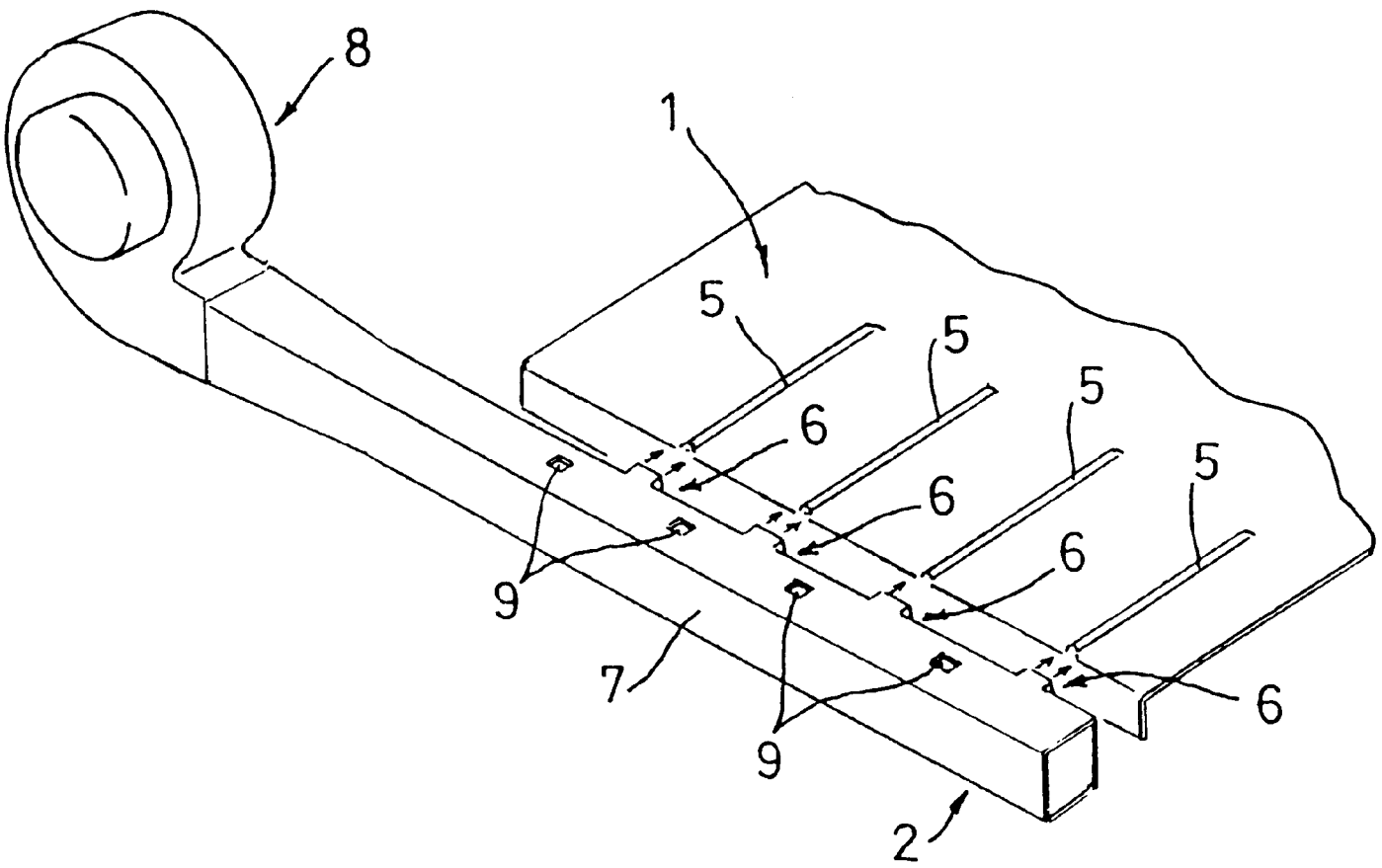
FIG. 2 is a fragmentary, perspective view of air suction means of the air suction type paper feeding device and the supply table depicted in FIG. 1.

FIG. 1 is a sectional view of an air suction type paper feeding device and FIG. 2 is a perspective view of blowing means and of a supply table in accordance with a first embodiment of the present invention. With reference to FIGS. 1 and 2, the air suction type paper feeding device includes a supply table 1 that is provided with an elevating mechanism (described below) which raises and lowers the supply table 1. The invention also includes a paper transferring mechanism 3 and a vacuum device 4 provided inside of the paper transferring mechanism 3. An upper surface of the supply table 1 is formed with a plurality of ribs 5 that slightly lift portions of papers P. The ribs 5 are generally parallel to one another and extend along the width of the supply table 1. A blowing means 2, as shown in FIG. 2, is formed with a plurality of blowing ports 6. The blowing ports 6 are aligned with the ribs 5 such that air exiting the blowing ports 6 moves toward the ribs 5 when the supply table 1 is moved to an uppermost position as shown in FIGS. 1 and 2.

Figure 3:
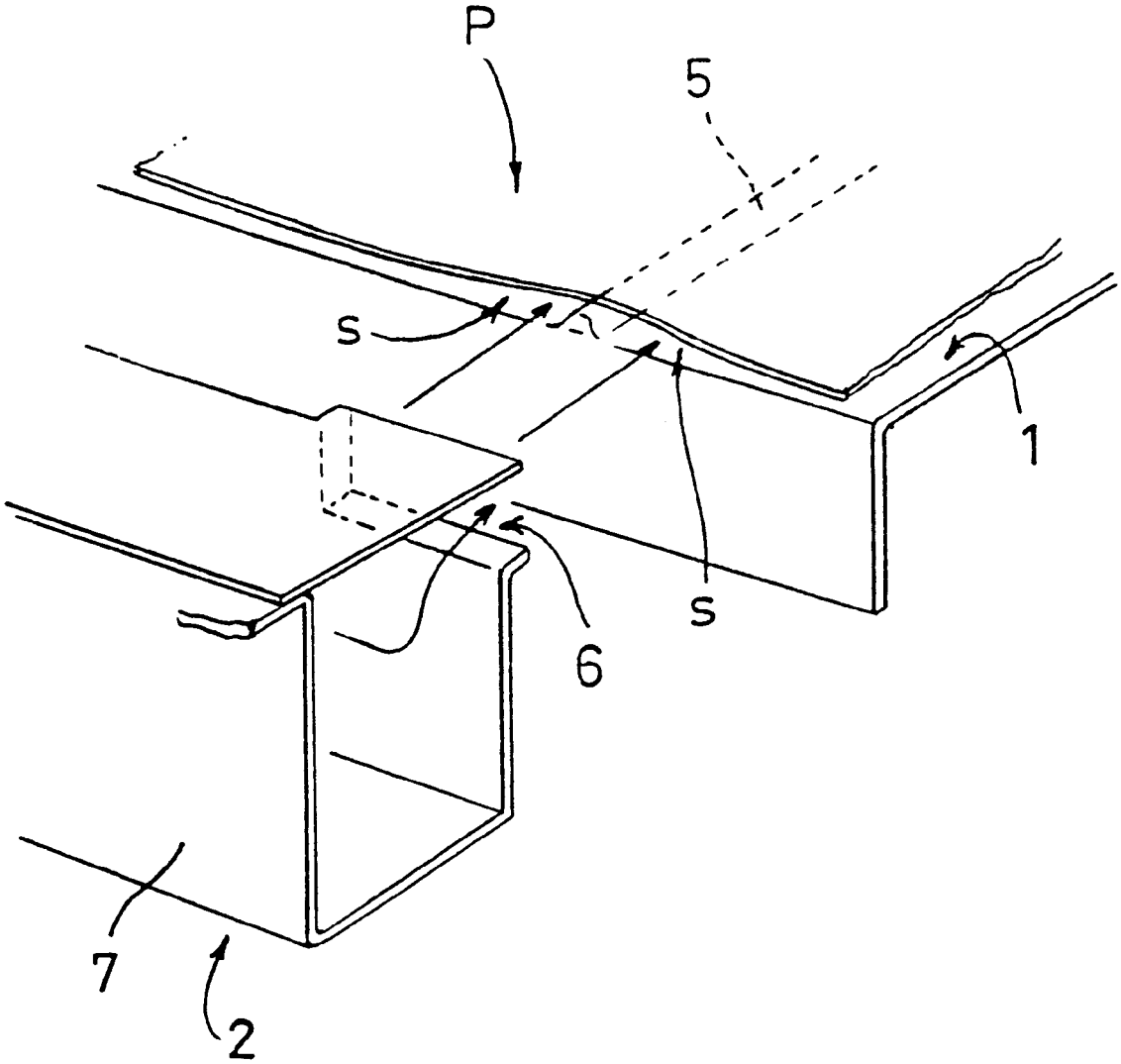
FIG. 3 is a fragmentary, perspective view of the air suction means depicted in FIG. 2, on an enlarged scale, showing details of one of several ribs formed on the supply table and a blowing port of the air suction means.

The presence of these ribs 5 on the supply table 1 provides a means for lifting a final paper P after a stack of papers has previously been removed. As shown in FIG. 3, the ribs 5 produce a clearances s between the bottom surface of the supply table 1 and the paper P which extends over the ribs 5. The clearances s reduces the contact area between the paper P and the bottom surface of the supply table, thus reducing the influence of attraction by static electricity. In addition, airflow to the space defined between the paper P and the supply table 1 by clearances s from the blowing ports 6, assures that the paper P is lifted irrespective of its thickness. The ribs 5 may extend from the front to rear of the supply table 1.

Figure 4A:
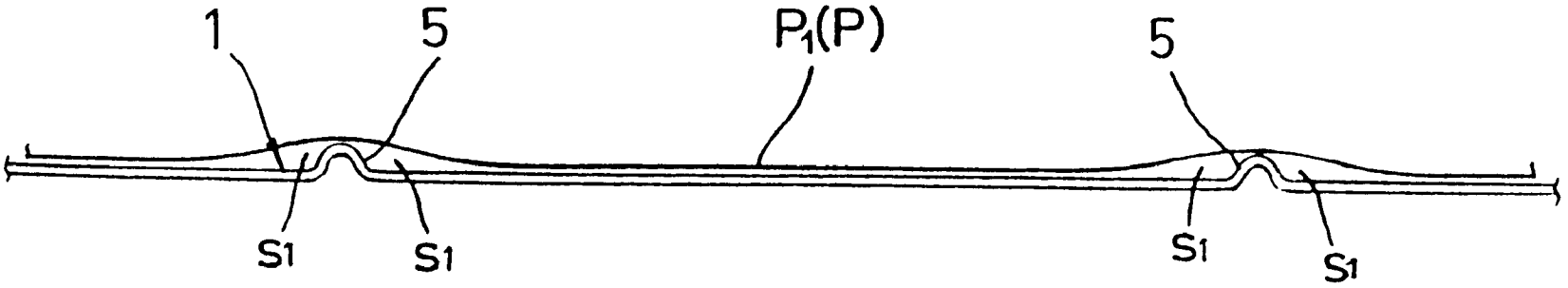
FIG. 4A is a fragmentary, side cross sectional view of the supply table in a state where a thin paper is lifted by the ribs.
Figure 4B:
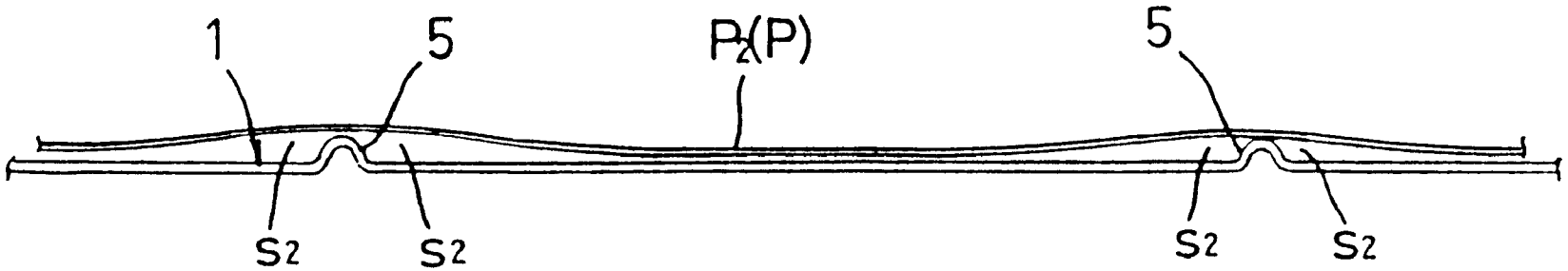
FIG. 4B is a fragmentary, side cross sectional view of the supply table a state where a thick paper is lifted by the ribs.

When a paper P1 is relatively thin, clearances s1 formed by ribs 5 are relatively small as shown in FIG. 4A. Further, when a paper P2 is relatively thick, clearances s2 formed by ribs 5 are relatively large as shown in FIG. 4B, because the paper P2 is tough and less flexible. Since the thin paper P1 is light, it can be lifted by a relatively small amount of air introduction. Although the thick paper P2 is heavy, a relatively large amount of air is introduced into the large clearances s2 to effect a strong lifting force, which ensures lift of papers, regardless of its thickness.

Referring again to FIG. 2, the blowing means 2 comprises a duct 7 having a rectangular cross section and a blower 8 connected to one end of the duct 7, with the blower 8 generating airflow. The duct 7 is fixed to a device body 100 (shown in FIG. 5) of the air suction type paper feeding device to a position corresponding to the front face of a supply table 1 with the supply table 1 in an upper position, as shown in FIGS. 1 and 2. Blowing ports 6 are formed in the duct 7 at locations corresponding to the ribs 5 and are opened in the side wall surface of the duct 7 facing the front face of the supply table 1. Jets 9 are also formed in an upper surface of the duct 7 for preventing multiple papers from being transferred at the same time. The end of the duct 7, shown in FIG. 2, is closed. The blowing means 2, coupled with the effect of the ribs 5, produces reliable lifting force, irrespective of the thickness of a paper P, due to the air flow output of the blower 8.

Figure 5:
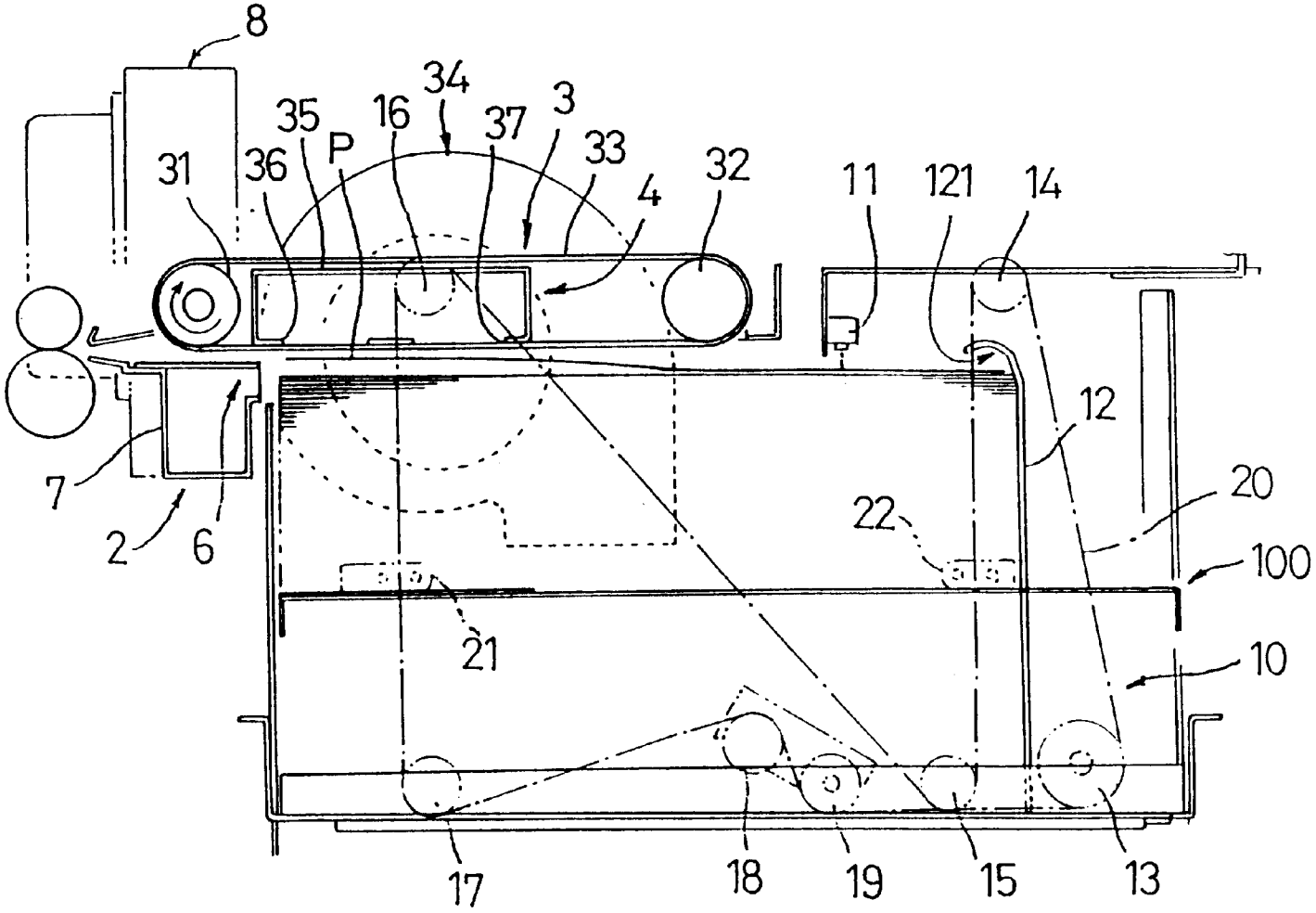
FIG. 5 is a side schematic diagram showing further structure of the air suction type paper feeding device in accordance with the first embodiment.

The supply table 1 is automatically elevated by an elevating mechanism 10 shown in FIG. 5. The elevating mechanism 10 is configured to raise the supply table 1 depending on the amount of remaining paper stacked on the supply table 1. For instance, the supply table 1 is raised automatically so that an uppermost paper P is at a level corresponding to blowing ports 6. Positioning control is performed by a control unit (not shown) that works in response to the height of the uppermost paper P as detected by a sensor 11 and, based on detection signals from the sensor 11, the control unit drives a motor (not shown) for raising and lowering the supply table 1. A plate 12 for urging the rear end of paper P is disposed in device body 100 proximate the rear of the supply table 1. The plate 12 is adjustable back and forth with respect to the device body 100. The sensor 11 may be of the contact type or of the non-contact type, and may be disposed above the supply table 1, as shown in FIG. 5 or may alternatively be elsewhere within the device body 100 for detection of the uppermost layer of the papers P. For example, the sensor 11 may alternatively be located in front of the supply table 1.

The elevating mechanism 10 includes a pulley 13 connected to the motor (not shown), driven pulleys 14, 15, 16, 17, tension pulleys 18, 19, and an endless belt 20 that loops around the pulleys 13, 14, 15, 16, 17, 18 and 19. The endless belt 20 is fixed to the supply table 1 in two places, i.e., in blocks 21, 22. The supply table 1 is incrementally moved upward according to the amount of remaining paper on the supply table 1, that is, from a lowermost position (not shown) to an uppermost position (see FIG. 1) corresponding to the blowing ports 6. Alternatively, the supply table 1 can be moved by, for example, an electric screw in place of the elevating mechanism 10.

The paper transferring mechanism 3, as shown in FIGS. 1 and 5, includes a drive pulley 31, a driven pulley 32, a belt 33 that is wrapped around the pulley 31 and the driven pulley 32. The belt 33 has a plurality of small holes formed therein. The paper transferring mechanism 3 also includes a vacuum device 4 that is provided inside of the transferring means 3 between the pulleys 31 and 32 and the belt 33. The vacuum device 4 includes a vacuum manifold 35 that is connected to a suction pump 34 that provides suction to create a vacuum in the vacuum device 4. The bottom of the vacuum manifold 35 is formed with openings 36 and 37. By sucking air from openings 36 and 37 papers P are vacuum-lifted to engage the underside of the belt 33.

Airflow is applied from the blowing ports 6 of the blowing means 2 to an upper layer of the papers P that are stacked on the supply table 1 in a paper feeding position, whereby the papers P in the upper layer are lifted and then separated so as to be easily vacuum-lifted. Furthermore, the airflow is from the blowing ports 6 contacts the rear end urging plate 12 and flows upward and then flows downward from a curved portion 121 formed on an upper portion of the urging plate 12. As a result, the top surface of an uppermost paper P is pressed and air introduced between the paper P and the underlying paper P separating the papers P, thus eliminating the need for a holding-down member. On the other hand, in the process of transferring a vacuum-lifted paper P, airflow from jets 9 produces an air curtain. This air curtain hinders the ends of papers P beneath the vacuum-adsorbed paper P from moving forward. The air curtain insures that only the uppermost paper P is moved and any underlying papers remain behind.

At the time when papers P are used and the supply table 1 reaches an uppermost position, air is introduced from blowing ports 6 into clearances s, formed by the ribs 5, as described above, which lift the final paper P from the upper surface of the supply table 1, leading to proper paper feeding.

Second Embodiment

Figure 6:
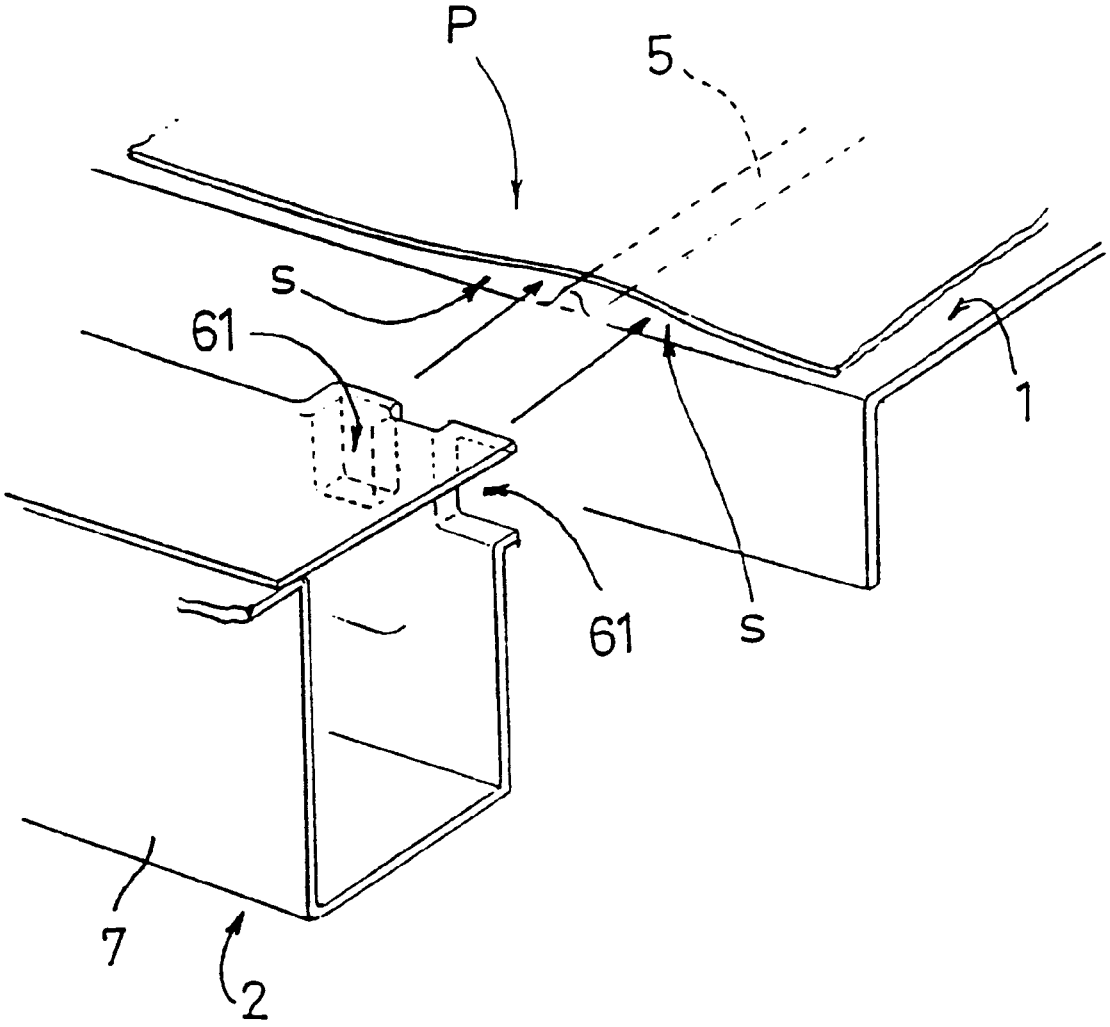
FIG. 6 is a fragmentary, perspective view, similar to FIG. 3, showing supply table and blowing port in accordance with a second embodiment of the present invention.

FIG. 6 shows a second embodiment of the present invention where an alternative blowing means 2 is shown. In the second embodiment, a plurality of pairs of blowing ports 61 are provided, each pair of blowing ports 61 positioned to correspond to opposite sides of the rib 5 on a supply table 1. The configuration of the second embodiment permits more efficient airflow introduction to papers P and clearances s.

Thus, in accordance with the air suction type paper feeding device of the first and second embodiments of the present invention, thanks to the structure resulting from the presence of ribs for slightly lifting papers on a supply table, extending in a paper transferring direction and blowing means for blowing air lifting the papers slightly above the supply table the papers lifted by the ribs, it is possible to reduce the contact area between the supply table and papers, even if they are thin, resulting in reduction of influence of attraction due to static electricity.

In addition, for thick papers, a larger area of clearance between the supply table and the paper by the ribs due to the stiffness of thicker paper, which permits a great lifting force by a constant amount of air blowing to obtain paper lifting force which is reliable.

Third Embodiment

Figure 7:
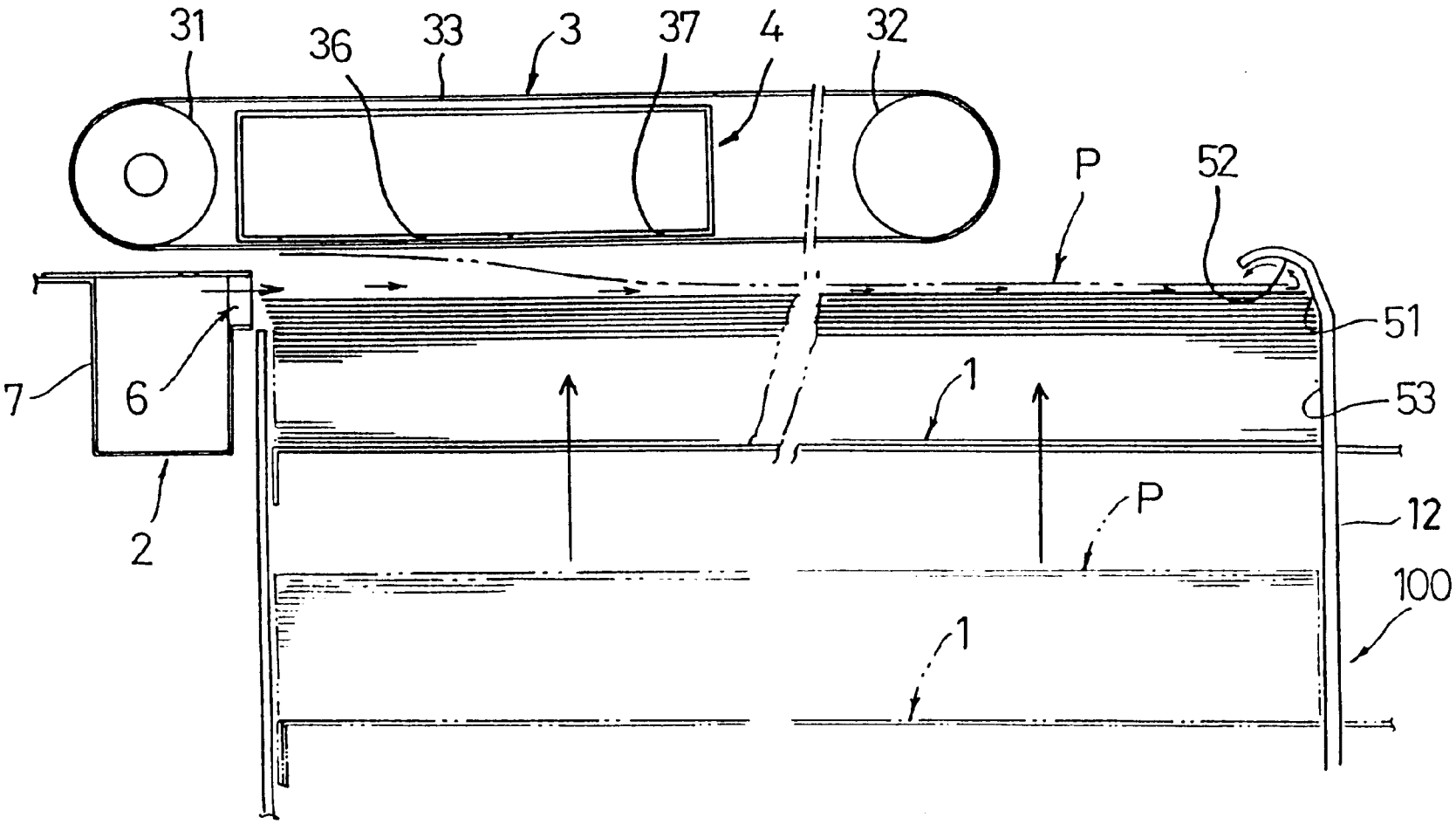
FIG. 7 is a fragmentary, cross sectional view showing an air suction type paper feeding device in accordance with a third embodiment of the present invention.

FIG. 7 is a sectional view of an air suction type paper feeding device in accordance with a third embodiment of the present invention. FIG. 2 is an enlarged view showing details of the device depicted in FIG. 1. The air suction type paper feeding device in accordance with the third embodiment includes a supply table 1 that, unlike the first and second embodiments, includes an elevating mechanism 10, but does not include ribs such as those described above with respect to FIGS. 1–6. The air suction type paper feeding device in accordance with the third embodiment also includes blowing means 2, a paper transferring mechanism 3 and vacuum device 4 disposed inside of the paper transferring mechanism 3. A rear end urging plate 12 for urging the rear ends of papers P is fixed to the device body 100 proximate a rear of the supply table 1 so as to be slidable in the direction of paper feeding.

The upper end of the rear end urging plate 12 is inclined toward a paper feeding direction defining an inclined surface 51, and a tip portion of the urging plate 12 is curved defining a curved surface 52. Airflow applied by the blowing means 2 to an upper layer portion of the papers P strikes the rear end urging plate 12 and the air flow reverses direction as a result of encountering the inclined surface 51 and the curved surface 52. The air flow is therefore diverted downward to hold down the upper surface of the rear of the papers P. Thus, air enters and is contained between the uppermost paper P and an underlying paper P so that one paper P at a time is effectively separated, preventing two papers from being transferred at the same time.

Figure 8:
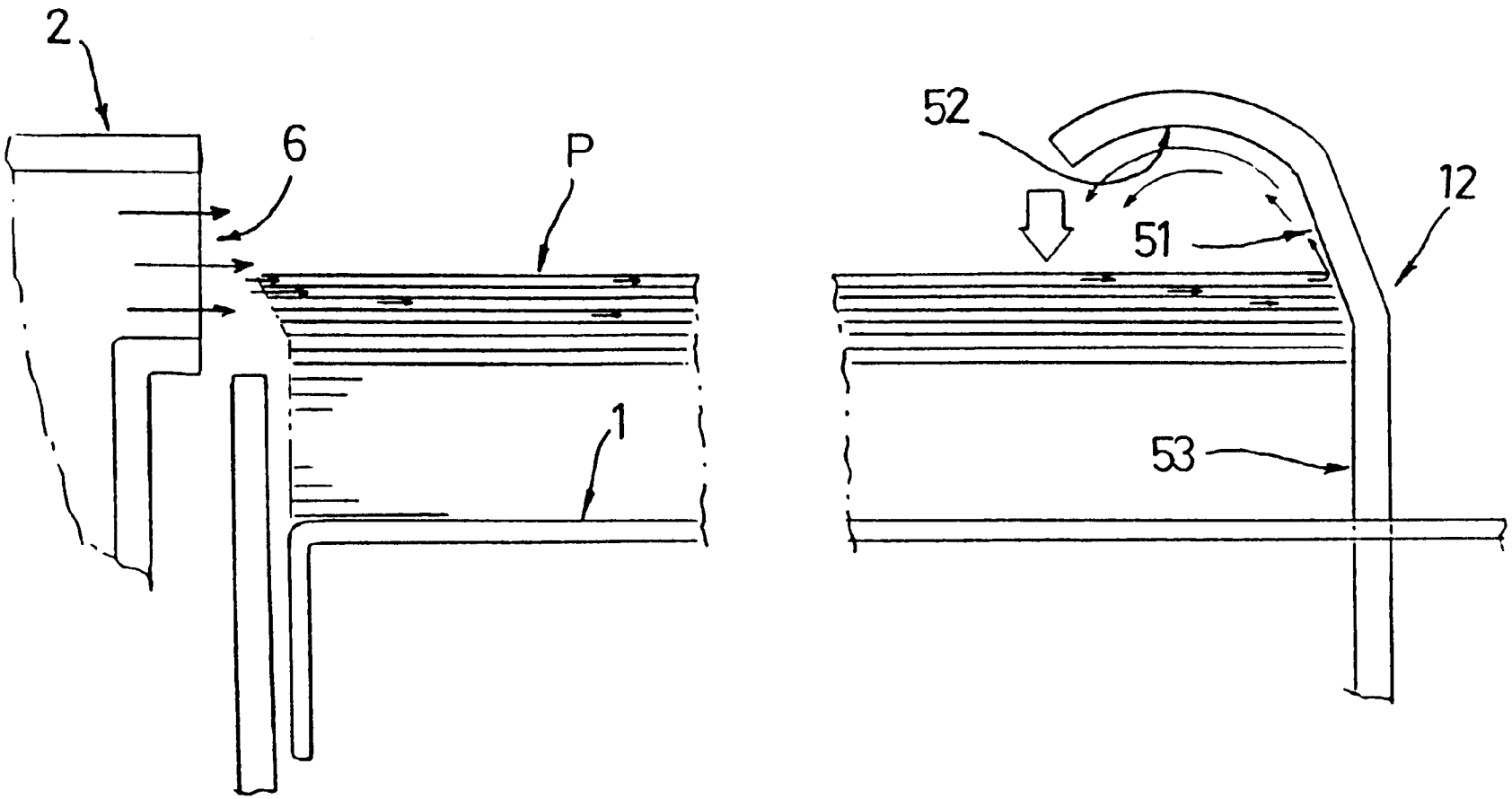
FIG. 8 is a fragmentary side view, showing a portion of the air suction type paper feeding device depicted in FIG. 7, on a slightly enlarged scale, showing details of a rear end urging plate in accordance with the third embodiment of the present invention.
Figure 9:
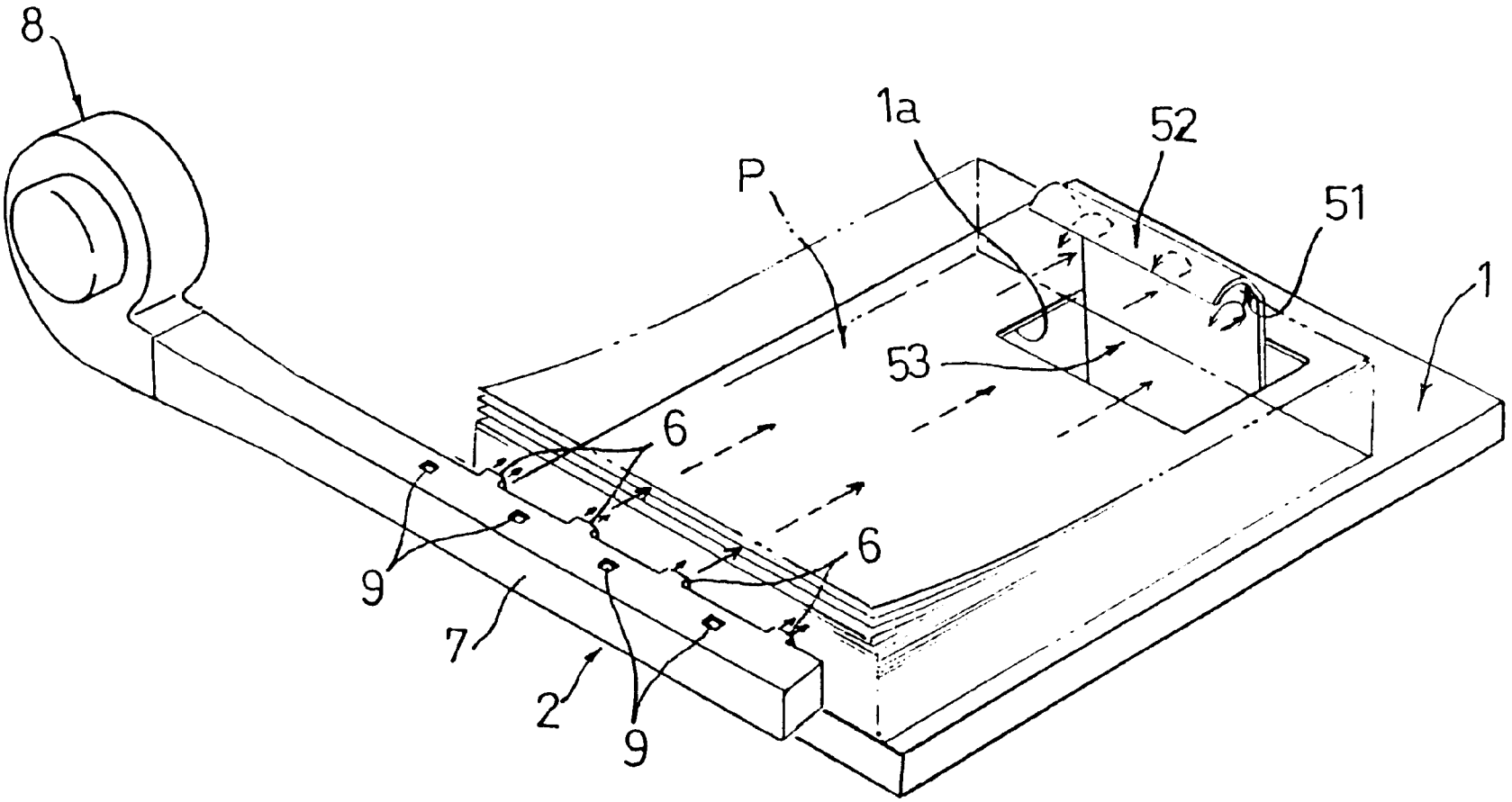
FIG. 9 is a perspective view of blowing means, a supply table and the urging plate depicted in FIGS. 7 and 8.

The lower end of the urging plate 12 fitted to the device body 100 such that it may be adjusted to correspond to the size paper installed on the supply table 1. For example, the lower end of the urging plate 12 may be fitted into grooves (not shown) in the device body 100 and may slide along the grooves for adjustment. However, once positioned, the urging plate 12 remains in position until further adjustments are made. The height of the plate 12 is set so that the upper end of the plate 12 extends through a rectangular opening 1*a* (FIG. 9) formed on the rear portion of the supply table 1. The portion of the urging plate 12 extending though the opening 1*a* contacts a rear end the papers P on the supply table 1. The urging plate 12 is further configured such that the upper most layers of paper on the supply table 1 contact the inclined surface 51, so that those papers P in contact with the inclined surface 51 are slightly pushed forward as is shown in FIGS. 7 and 8.

Papers P are loaded on the supply table 1 with the supply table 1 in a lower feeding position, as is indicated by the dashed lines in FIG. 7. When loaded, the papers are stacked such that their rear edges define a vertical line against a vertical surface 53 of the urging plate 12. At the start of feeding operation, the supply table 1 is lifted. As the papers are raised, the rear edges of the upper layers of the papers P come into contact with the inclined surface 51, so that the upper layers of paper are slightly pushed forward, as shown in enlarged scale in FIG. 8.

In this manner, the upper layers of paper are slightly pushed forward facilitating the introduction of airflow between the upper most layers of paper P from the blowing means 2, leading to effective paper separation between the papers P. In addition to the separation between an uppermost paper P and the underlying paper P, papers P beneath are likewise subsequently separated. This, coupled with the diverted air holding-down action as described above, reliably prevents more than one sheet of paper from being transferred at any one time.

It is suitable that the curved surface 52 on the upper end of the urging plate 12 be formed so as to point airflow downward, or be formed in a bent shape. The inclined surface 51 is preferably formed so that the upper layers of the papers P are obliquely pushed forward slightly, as shown in FIG. 2. Alternatively, the inclined surface 51 may be formed so as to produce a structural continuity between the vertical surface 53 and the curved surface 52. That is, the upper end of the curved surface 52 may be curved or inclined so that airflow applied from its front is pointed downward at the upper end of the rear end urging plate 12 to hold down the rear of the papers P.

Referring to FIG. 3, the blowing means 2 comprises a duct 7 having a rectangular cross section and a blower 8 for generating airflow connected to one end of the duct 7. The duct 7 is fixed to a position along the front face of a supply table 1. Blowing ports 6 are opened in the side wall surface of the duct 7, opposite to the front face of the supply table 1. Jets 9 are opened in a top wall surface of the duct 7 for further preventing multiple sheets of papers from being transferred at one time. The end of the duct 7 (the forward most end in FIG. 9) is closed.

Figure 10:
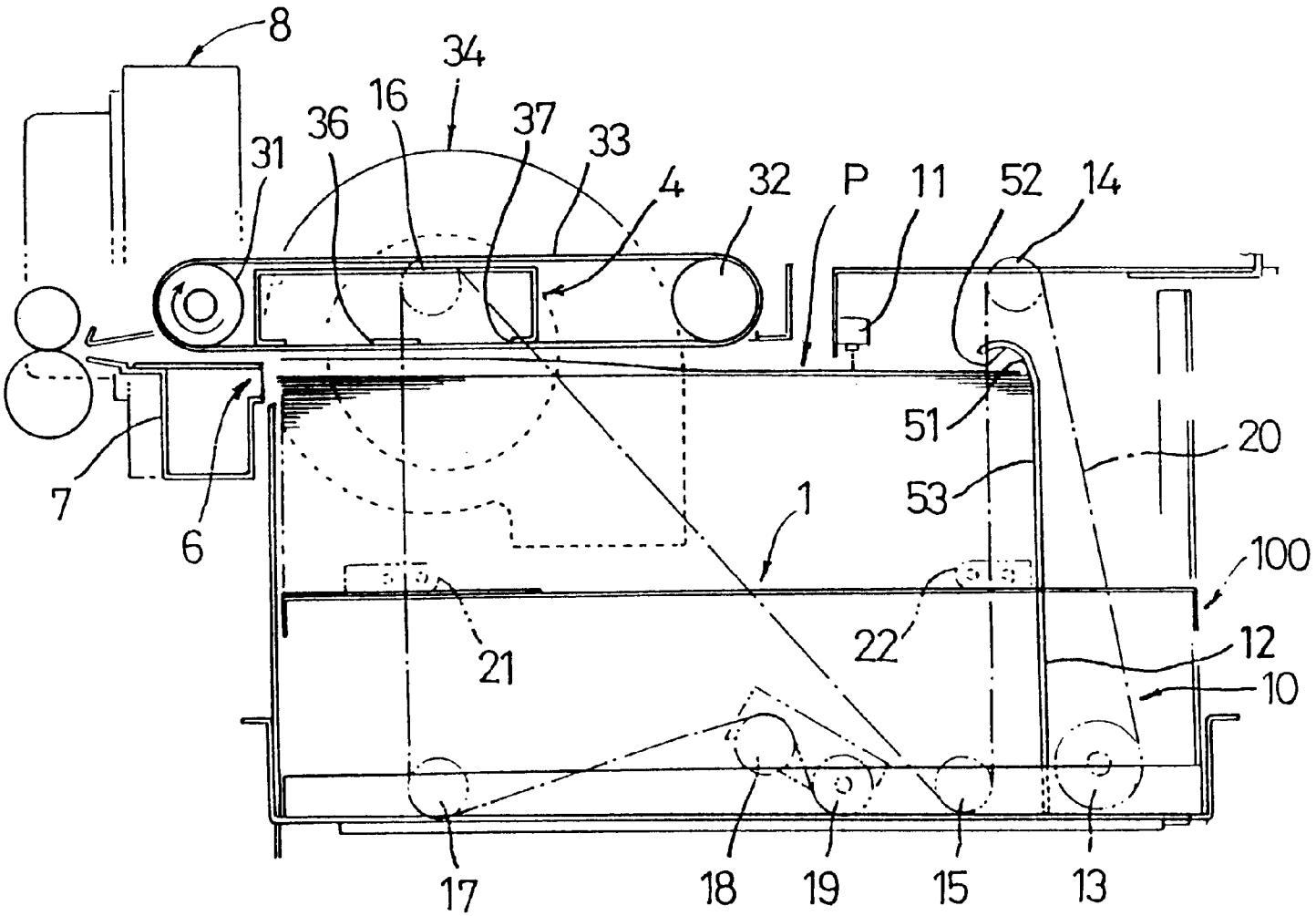
FIG. 10 is a side schematic view showing further structure of the air suction type paper feeding device depicted in FIGS. 7, 8 and 9.
Figure 11:
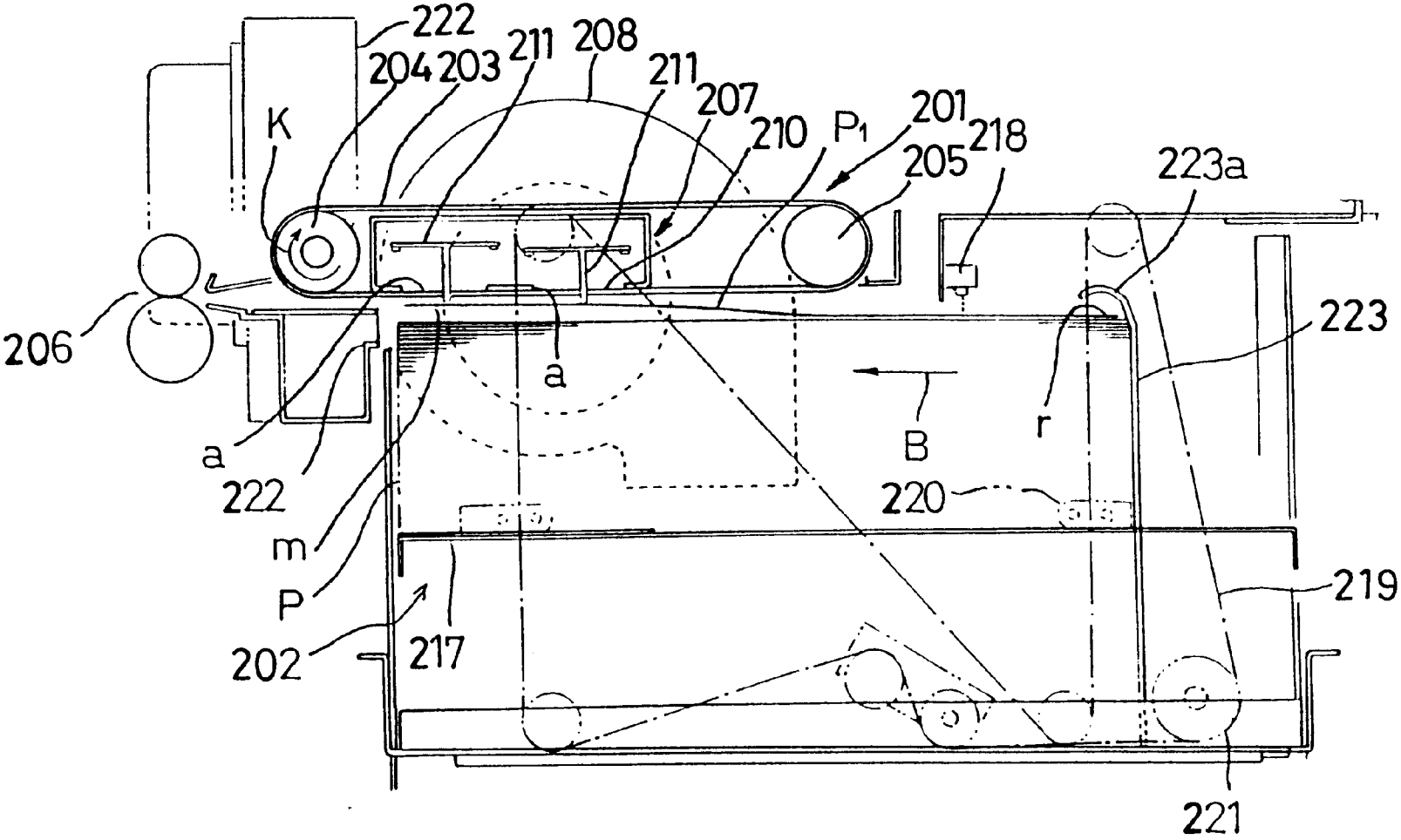
FIG. 11 is side schematic view showing an overall structure of an air suction type paper feeding device in accordance with a fourth embodiment of the present invention.

The supply table 1 is automatically raised and lowered by an elevating mechanism 10 (see FIG. 10) in a manner similar to that described above with respect to the first embodiment. The supply table 1 position is detected by a sensor 11 and, based on detection signals, the drive of a driving source is controlled. The sensor 11 may be of the contact type or of the non-contact type, and may be suitably disposed in anywhere within the device body 100 where it is able to detect an uppermost layer of the papers P, for example, in the front of the supply table 1.

The elevating mechanism 10 includes a pulley 13 connected to a driving source, driven pulleys 14, 15, 16, 17, tension pulleys 18, 19, and an endless belt 20 that extends around the pulleys 13 through 19. The endless belt 20 is fixed to the supply table 1 in two places, i.e., at blocks 21, 22. The supply table 1 is gradually moved in a step-wise manner in accordance with the amount of remaining paper, that is, from a lowermost position (not shown) to an uppermost position (see FIG. 7) adjacent to the blowing ports 6. The supply table 1 can be moved by, for example, an electric screw in place of the elevating mechanism 10.

The paper transferring mechanism 3 includes a drive pulley 31, a driven pulley 32 and a belt 33 having a plurality of air holes formed therein. The belt 33 extends around the pulley 31 and the driven pulley 32. The paper transferring mechanism 3 also includes vacuum device 4 provided inside the transferring means 3. The vacuum device 4 includes a suction pump 34 serving as a suction source and a vacuum manifold 35 connected to the suction pump 34. By sucking air from openings 36, 37 in the bottom of the vacuum manifold 35, papers P are vacuum-lifted toward the underside of the belt 33, the air being sucked up through the holes in the belt 33.

The upper layers of the papers P stacked on the supply table 1 are separated so as to be easily vacuum-lifted as previously mentioned, and the rear of the uppermost paper P is held down by airflow flowing downward and air introduced between the paper P and the underlying paper P expands to separate the two top most papers P, thus eliminating the need for a holding-down member. On the other hand, in the process of transferring a lifted paper P, airflow from jets 9 produces an air curtain. This air curtain hinders the ends of papers P beneath the vacuum-adsorbed paper P from moving forward. This, coupled with the effect of the separation as described above, further reliably prevents the uppermost paper P and the underlying paper from being transferred at the same time.

As described above, in accordance with the air suction type paper feeding device of the present invention, the presence of a rear end urging plate having an upper end being curved or inclined in a paper feeding direction, on the rear of the supply table, allows air flow applied by the blowing means to be turned over at the upper end to hold down an upper surface of the rear of an uppermost paper in a proper paper feeding position. Thus, air expansion between the uppermost paper and the underlying paper permits effective paper separation, without requiring a paper holding-down member.

It should be understood that the first and second embodiments described above with respect to FIGS. 1–6 may also alternatively include the features of the urging plate 12 with the surfaces 51, 52 and 53.

Fifth Embodiment

Figure 12:
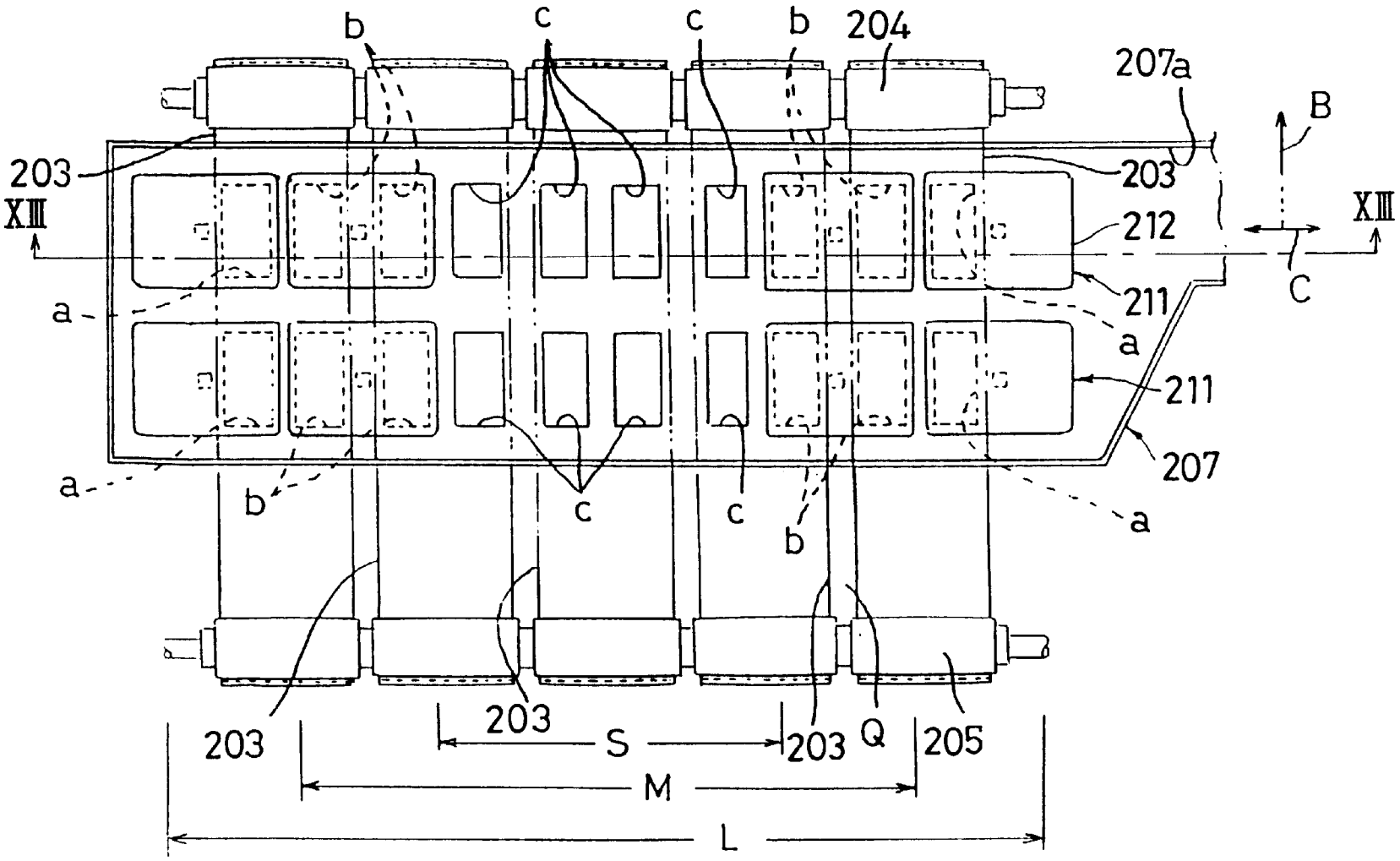
FIG. 12 is a top view of the air suction type paper feeding device depicted in FIG. 11 in accordance with the fourth embodiment of the present invention.

A fifth embodiment of the present invention is depicted in FIGS. 11, 12, 13, 14, 15 and 16. With reference to FIGS. 11 through 16, an air suction type paper feeding device 201 is used in, for instance, an image forming apparatuses (not shown). The air suction type paper feeding device 201 includes a paper tray 202 on which several sizes stacked papers P may be positioned, for instance, paper widths: L (large); M (medium); and S (small). However, only one size at a time would be stacked on the tray 202 at any one time. The stack of paper is typically centered on the tray 202, as is indicated in FIG. 12 where the size of the paper is indicated by L, M and S.

The air suction type paper feeding device 201 also includes five paper feeding belts 203, each belt 203 having a plurality of small holes making each belt 203 air permeable. The belts 203 are arranged parallel to one another in a side by side arrangement for subsequent engagement with the various sizes of the paper widths L, M, and S (see FIG. 12). The belts 203 extend in a direction corresponding to the direction of paper feed (the paper feed direction shown by the arrow B in FIG. 12). Each paper feeding belt 203 is wound on a drive roll 204 and a driven roll 205 that are rotated and driven in direction K (FIG. 11) by a motor (not shown). An uppermost paper P1 of stacked papers P (see FIG. 11) is lifted by vacuum driven air (described below) thus contacting the belts 203, the belts are rotated and then feed the paper P1 toward a pair of paper feeding rollers 206.

A vacuum manifold 207 having a rectangular cross-section (see FIGS. 11 and 12) extends in a direction C (FIG. 12) inside the five paper feeding belts 203 and between the rollers 204 and 205. One end of the vacuum manifold 207 is formed with a connecting port 207*a* for connecting a suction pump 208, the port 207*a* extending in the longitudinal direction C (FIG. 12).

An undersurface portion 210 of the vacuum manifold 207 has a plurality of vacuum ports, such as the twenty suction ports a, b, c, . . . shown in FIG. 12, each of the suction ports a, b, c having a generally identical rectangular shape. As shown in FIG. 12, on the undersurface portion 210, suction ports c are positioned in a central location with respect to the five paper feeding belts 203 and the paper feed direction B. The suction ports b and a are symmetrically positioned on opposite sides of the ports c ports a, the opposite sides being relative to the direction C, such that the suction ports c, b and a together are also centered with respect to the five paper feeding belts 203 and the paper feed direction B.

Among the twenty suction ports a, b and c, the eight suction ports c shown in FIG. 12 are positioned such that they are used in providing vacuum to engage all three sizes of paper L, M and S, as is described in greater detail below. The suction ports b are positioned such that they providing vacuum to engage only the paper sizes M and S, as is described in greater detail below. The suction ports a are positioned such that they provide vacuum to engage only the paper size L. For the twelve suctions a and b shown in FIG. 12, eight covers 211 are provided for selectively closing the suction ports a and b.

Figure 16:
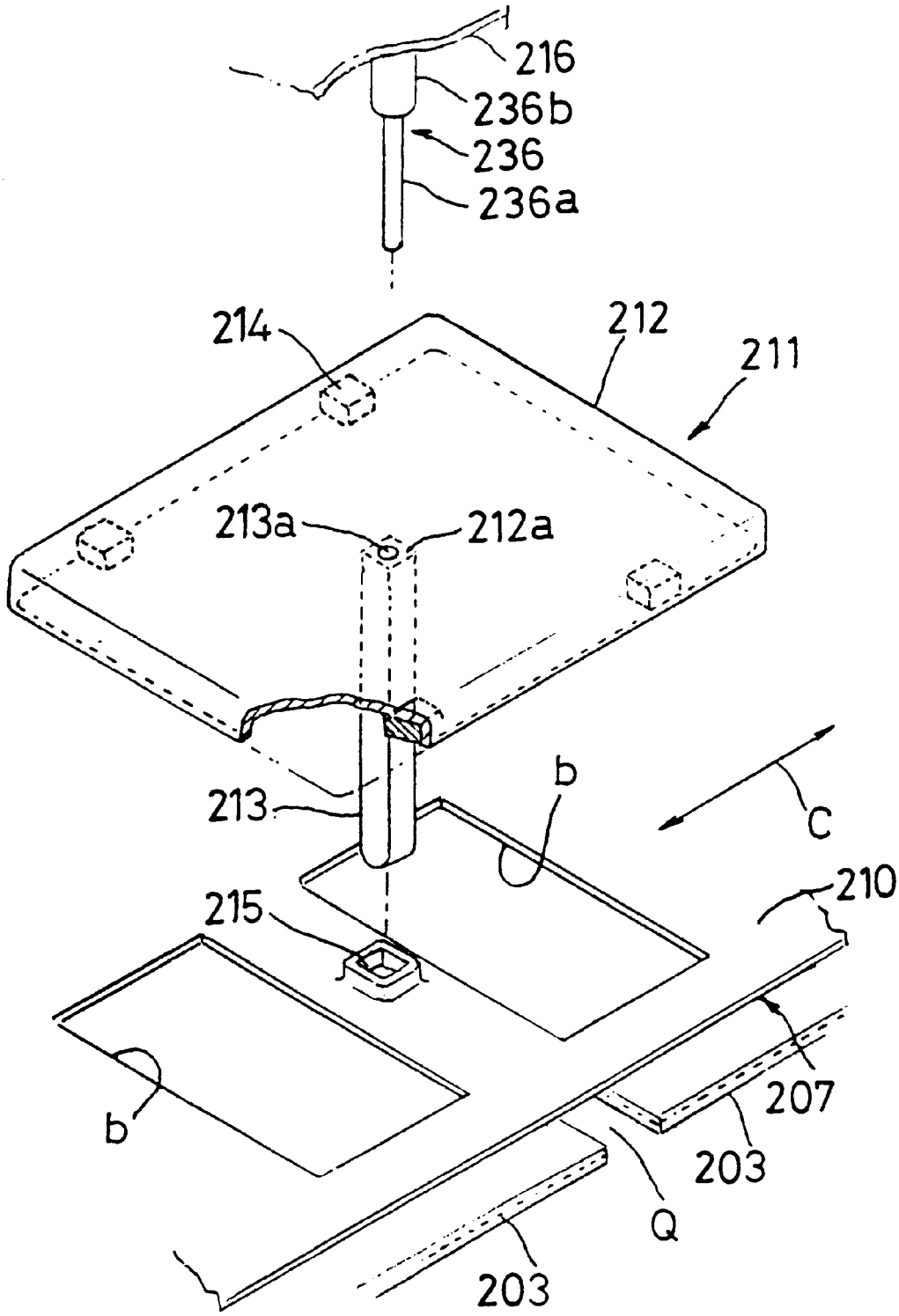
FIG. 16 is a fragmentary, exploded perspective view of the portions of the air suction type paper feeding device depicted in FIG. 15.

Each cover 211 is formed a plate portion 212 having a generally flat plate shape for covering up to two suction ports b or one suction port b one suction port b and one suction port a as shown in the various positions of the covers 211 in FIGS. 12, 13 14A and 14B. Each cover 211 also includes a column 213 that extends downward from an undersurface of a central portion 212*a* of the plate portion 212 (see FIG. 16). There are magnets 214 attached to the four corners of the undersurface of each plate portion 212, as shown in FIG. 16.

Between each pair of adjacent belts 203 there is defined a space Q. On the portion 210 of the vacuum manifold 207 that corresponds to the space Q between the two adjacent paper feeding belts 203, openings 215 are formed. There are also openings 215 formed adjacent to the outer edge of the two outermost belts 203. The columns 213 each extend through a corresponding one of the openings 215 as shown in FIGS. 13, 14A, 14B, 15 and 16. The columns 213 and the openings 215 are square in shape such that the columns 213 cannot rotate within their respective openings 215.

Figure 15:
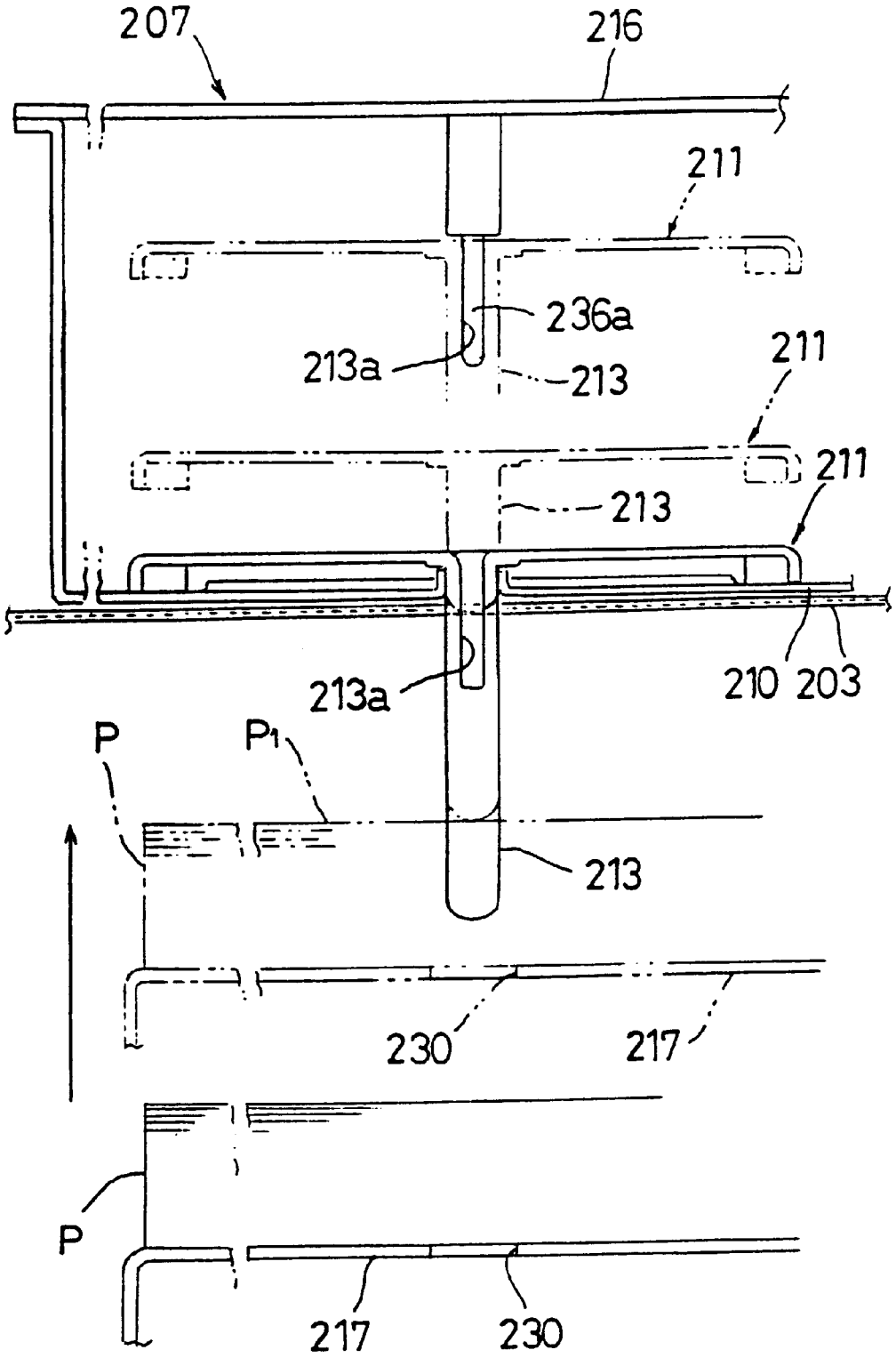
FIG. 15 is a further fragmentary enlargement of a portion of the air suction type paper feeding device depicted in FIGS. 14A and 14B, showing details of vacuum operation in the fourth embodiment of the present invention.

A hole 213*a* is formed in the center of the column 213. Each hole 213*a* extends a predetermined depth into a corresponding column 213, as shown in FIG. 15. On an inner upper surface of the top portion 216 of the vacuum manifold 207, in positions corresponding to the openings 215 a plurality of supporting members 236 are formed. The supporting members 236 has a small diameter projection 236*a* that projects downward so that it may extend into a corresponding hole 213*a*. A large diameter portion 236*b* of the supporting member 236 serves as a stopper when supporting the cover 211, as is described in greater detail below.

The paper tray 202 includes a bottom plate member 217 for lifting stacked papers P. As with the first, second and third embodiments described above, the paper tray 202 and the bottom plate member 217 may be raised and lowered in accordance with paper consumption. The position of the bottom plate member 217 is controlled by a control system (not shown) that responds to signals from a sensor 218. The control system controls an elevating mechanism includes a belt 219, a supporting member 220, and various rollers 221.

Figure 13:
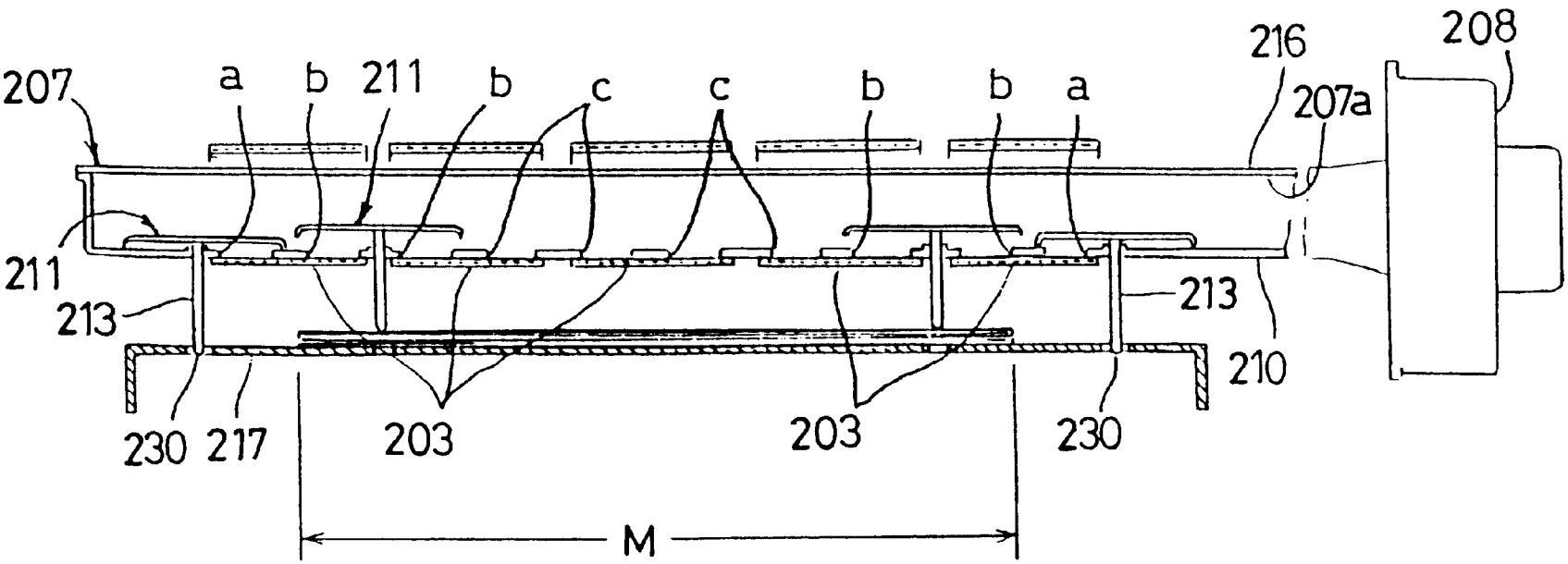
FIG. 13 is a side cross sectional view taken along the line XIII—XIII in FIG. 12, looking in the direction of the arrows, showing details of the air suction type paper feeding device.

Corresponding columns 213 of the covers 211 abut the uppermost paper P1 as the bottom plate member 217 is raised, thereby pushing the column 213 upward. The bottom plate member 217 is formed with a plurality of fitting holes 230 that correspond in location and size to the tip of the column 213, as shown in FIGS. 13 and 15, such that if there is no paper between the tip of the column 213 and the bottom plate member 217, the columns 213 may extend into corresponding fitting holes 230 as the bottom plate member 217 rises in response to paper consumption.

A duct 222 connected to a blower (not shown) provides air flow in a manner described above with respect to the first, second and third embodiments. The air flow from the duct 222 prevents the uppermost paper P1 and the immediate underlying paper from being transferred at the same time. A urging plate 223 similar to that described above has a receiving portion 223*a* that receives the flow of air from an air outlet of the duct 222 and directs the air flow downward on to the rear end portion r of the paper P1. The presence of the duct 222 and the receiving portion 223*a* assists in prevents the uppermost paper P1 and the underlying paper from being transferred simultaneously.

Below is a description of the transferring of papers having a maximum width L.

First, with the bottom plate member 217 in a lowered position, as shown in solid lines in FIG. 15, the tips of all columns 213 extend downward but are not in contact with any paper. Hence, all of the suction ports a and b are closed by the covers 211 which firmly engage the portion 210 of the vacuum manifold 207 due to force of the magnets 214. As the bottom plate member 217 is raised, as is indicated in dashed lines in FIG. 15 and further shown in FIG. 14A, those columns 213 that are above the stacked paper P are moved upward, thus lifting the covers 211 and opening the suction ports a and b. Therefore, the suction pump 208 is able to efficiently lift the top paper P1 having a width L for engagement with the air permeable belts 203, while the air from the duct 222 prevents further papers P from being lifted. During this action, the cover 211 is pushed up toward the portion 216 of the vacuum manifold 207 as shown by the dashed lines in FIG. 15. The hole 213*a* is then engaged with the small diameter projection 236*a* of the supporting member 236 that is located immediately above the hole 213*a* of the column 213, it is possible to assuredly prevent subsequent undesired movement of the cover 211 due to the flow of air in the vacuum manifold 207.

Figure 14A:
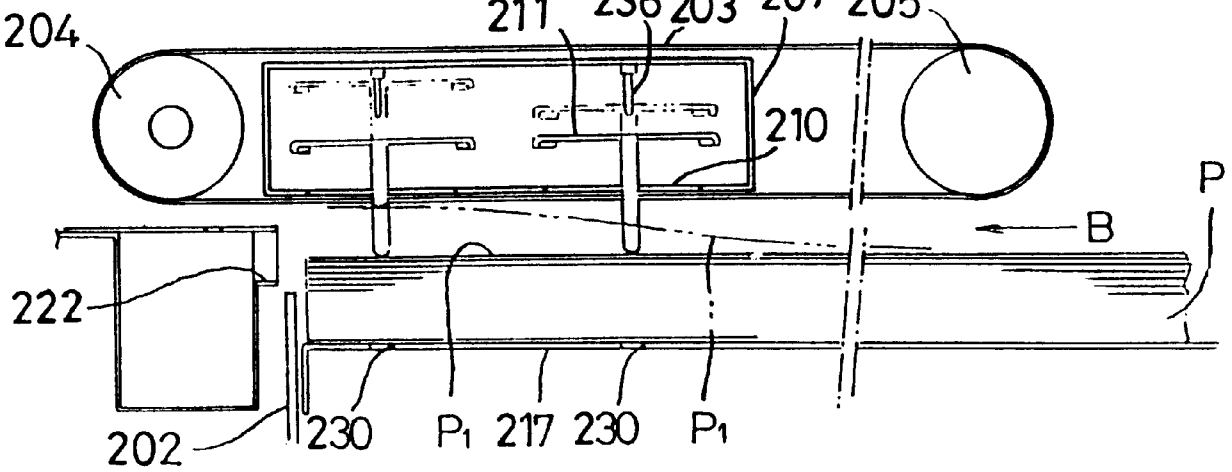
FIGS. 14A and 14B are side schematic views, similar to FIG. 11, on a slightly enlarged scale, showing a portion of the air suction type paper feeding device depicted in FIGS. 11, 12 and 13, FIG. 14A showing one operational state, and FIG. 14B showing a second operational state.
Figure 14B:
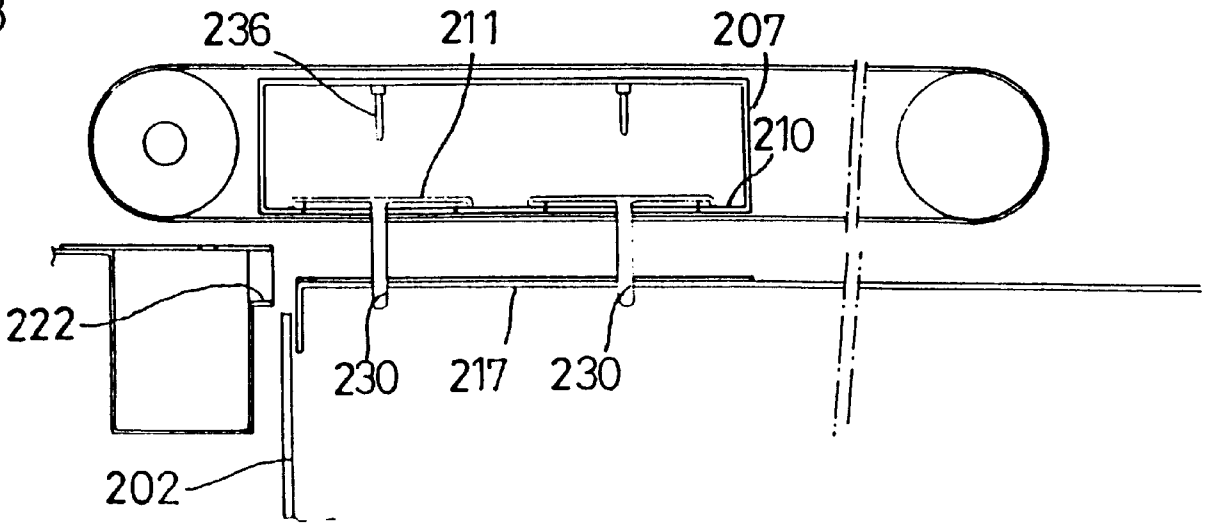

For papers having a medium width M, not all of the covers 211 are lifted as the papers P are lifted upward. Only the covers 211 which are disposed above the suction ports b are pushed up as papers P with a width M are moved upward. The covers 211 which are disposed above the suction ports a are not lifted as the papers P having a width M are lifted, as shown in FIG. 14B. In this case, the covers 211 above the suction ports a are remain in contact with the portion 210 of the vacuum manifold 207 preventing flow of air through the suction ports a. As well, as the stacked paper P is consumed, the corresponding columns 213 extend through corresponding holes 230 in the bottom plate member 217 to insure that the suction ports a remain closed as the paper P having width M is consumed.

For the case where papers of minimum width S are centered on the bottom plate member 217, none of the covers 211 are moved upward as the bottom plate member 217 moves upward and as a consequence only the suction ports c are opened for air flow. The covers 211 seal the suction ports b and a and as the paper is consumed and the bottom plate member 217 further moves upward, the columns 213 extend into the holes 230, as shown in FIG. 14B.

When all papers P have been consumed and the bottom plate member 217 is empty, the condition of the covers 21 and the columns 213 is similar to that shown in FIG. 14B where the columns 213 extend into the holes 230 and all corresponding suction ports b and a are closed. Specifically, with a bottom plate member 217 lifted to an upper most position, the suction ports a and b are sealed shut by the forces of the magnets 214 and the weight of the cover 211. This results in the state where the tip of the column 213 is inserted into the hole 230, and the column 212 is supported by the portion 210 of the vacuum manifold 207 through the magnets 214.

Fifth Embodiment

Figure 17:
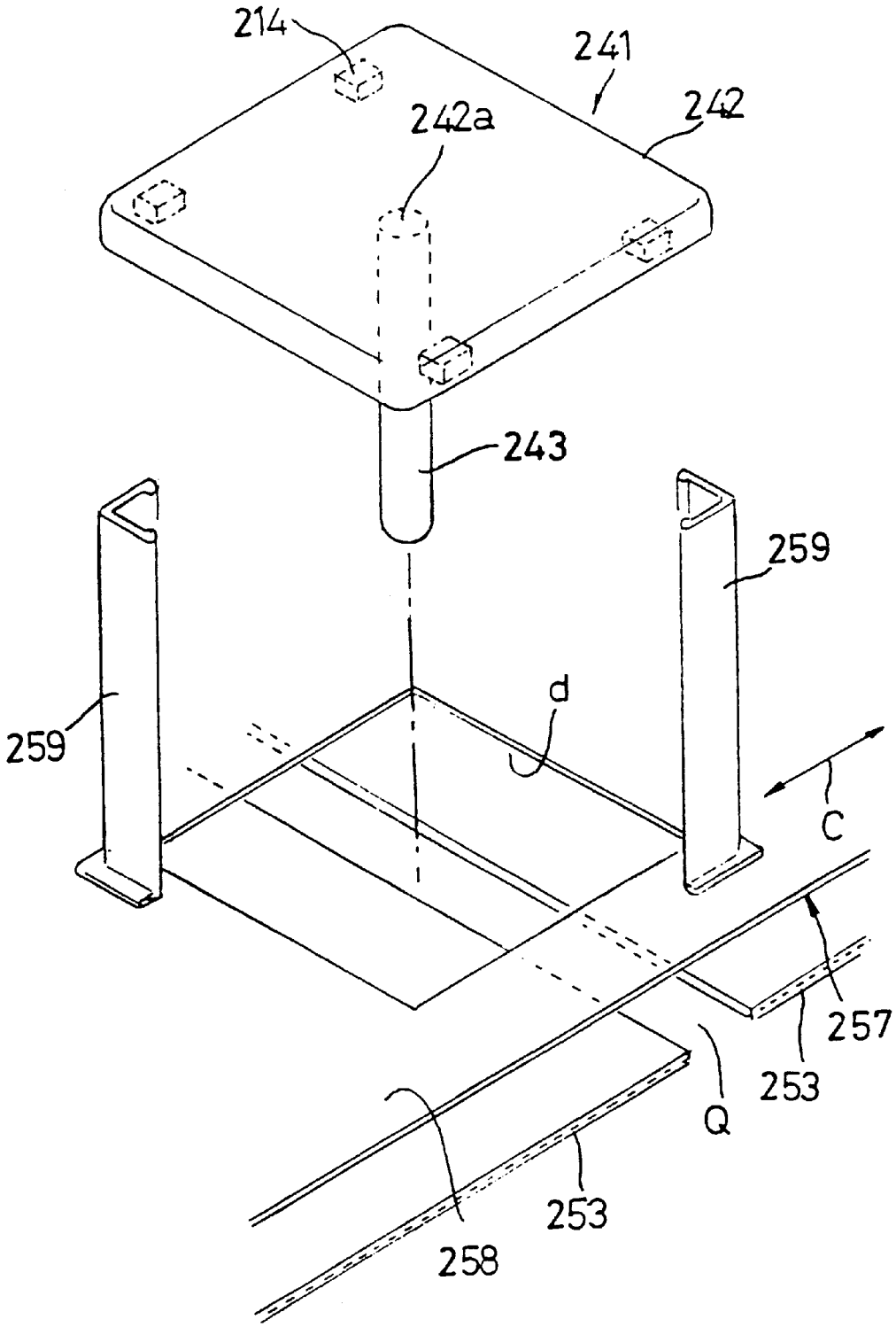
FIG. 17 is a fragmentary, exploded perspective view similar to FIG. 16, showing portions of an air suction type paper feeding device in accordance with a fifth embodiment of the present invention.

FIG. 17 shows a fifth embodiment of the present invention, which is directed to prevention of movement or vibration of the a cover 241 by guide pieces 259 when a suction port d is opened.

Referring to FIG. 17, a cover 241 has a shape similar to the rectangular suction port d. The rectangular suction port d is formed in a portion 258 of a vacuum manifold 257 which extends perpendicular to paper feeding belts 253. The cover 241 includes a plate-shape roof 242 for covering the suction port d and a column 243 that is integrally formed downward from an undersurface of a central portion 242*a* of the roof 242. Magnets 214 attached to four corners of the undersurface of the roof 242. A pair of guide pieces 259 whose shape is approximately L-type in cross section, projects upward from the portion 258 of the vacuum manifold 257, are formed about each of the corners of the suction port d. Therefore, even if the cover 241 moves due to suction force and then descends, the guide pieces 259 assuredly guide the roof 242 to prevent the backlash of the cover 241.

Although the above embodiments show a cover moved upward by lifting force due to contact with an uppermost paper to open a suction port, the cover may be alternatively be opened by a solenoid.

Although the above preferred embodiments show where papers are set on center basis, the present invention is also applicable to where papers are offset or rotated 90°. In such a case, suction ports are opened or closed in accordance with contact of the column with the paper to allow for vacuum from the vacuum manifold through the corresponding suction port. Only those suction ports needed are opened.

In addition, although the description has been given of cases where papers classified into three paper sizes are sucked, the present invention is also applicable to papers classified into two, four, or more sizes.

As described, in accordance with the present invention, an air suction type paper feeding device having a paper feeding belt with air permeability disposed above stacked papers, and a suction duct including a plurality of suction ports, disposed inside of the paper feeding belt, so as to lift and transfer an uppermost paper of the stacked papers by air, characterized in that it also includes a cover for closing a specific suction port or ports that does not relate to paper transferring when papers other than those having a specific width.

Thanks to the above structure, it is possible to provide an air suction type paper feeding device that transfers an uppermost paper of stacked papers by preventing air from escaping through suction ports, irrespective of the size of paper.

It should also be understood that the fourth and fifth embodiments described above may also include a bottom plate member 217 that is formed with the ribs 5 described above with respect to the first and second embodiments.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is;:

1. A vacuum sheet-feeding device for supplying paper in an image reproducing apparatus, the sheet-feeding device comprising:

an elevatable sheet supply tray having a bottom formed with at least one rib extending in a sheet feeding direction of the sheet-feeding device and means for elevating said sheet supply tray, said sheet supply tray for retaining sheets in a stacked supply in an image reproducing apparatus, wherein said sheet supply tray is elevatable to an uppermost position in response to sheet feeding serially from the stacked supply down to a bottom sheet;

a blowing means having at least one blowing port for blowing air toward a leading end of said sheet supply tray in the sheet feeding direction;

a vacuum source and associated air-permeable belts disposed over said sheet supply tray for taking up by suction and transferring an uppermost sheet on said sheet supply tray; wherein said blowing port and said rib in the bottom of said sheet supply tray are aligned such that air from said blowing port flows directly about said rib when said sheet supply tray is elevated to the uppermost position.

2. The vacuum sheet-feeding device as set forth in claim 1, further comprising:

a sheet stack urging plate disposed at a trailing end of said sheet supply tray in the sheet feeding direction and extending above said sheet supply tray, said sheet stack urging plate having an upper end with an inclined portion configured for abutting the sheets in a stacked supply, urging the uppermost sheet on said sheet supply tray toward the leading end thereof, said sheet stack urging plate being further formed with a curved portion bending down from said inclined portion toward said sheet supply tray;

whereby air flow from said blowing means is directed by said inclined portion and said curved portion down toward the uppermost sheet on said sheet supply tray in order to restrain any sheets beneath the uppermost from moving with taking up by suction and transferring of the uppermost sheet.

3. The vacuum sheet-feeding device as set forth in claim 1, wherein said belts extend around a portion of said vacuum source, said vacuum source includes a manifold having a plurality of suction ports, at least one of said suction ports having a corresponding cover disposed within said manifold, said cover having a column extending downward from said cover through said suction port, said cover covering said suction port, said column configured for engagement with the stacked paper and in response to engagement with the stacked paper, said column lifts said cover to open said suction port.

4. A vacuum paper feeding device for image forming apparatus, comprising:

a paper supply table configured to be raised in response to paper consumption, said paper supply table having a front end and a rear end;

a blowing means for blowing air from a front end of papers staked on said paper supply table toward a rear end of the stacked papers;

a vacuum source and corresponding air permeable belts for moving and transferring an uppermost one of the stacked paper;

a rear end urging plate extending above an upper surface of said paper supply table proximate said rear end thereof, said urging plate having an upper end having an inclined portion configured for engagement with the stacked papers urging the uppermost of the stacked papers toward said front end of said paper supply table, said urging plate being further formed with a curved portion which arcs from said inclined portion toward the stacked papers;

whereby air flow from said blowing means is directed by said inclined portion and said curved portion down toward an uppermost paper of the stacked papers in order to prevent further papers of the stacked papers from moving with movement of the uppermost paper.

5. The vacuum paper feeding device as set forth in claim 4, wherein said paper supply table includes at least one rib formed which extends along an upper surface thereof for slightly lifting the stacked papers, said rib configured to allow air from said blowing means to flow between a bottom paper of the stacked paper and said upper surface of said paper supply table with said paper supply table in an upper position.

6. The vacuum paper feeding device as set forth in claim 4, wherein said belts extend around a portion of said vacuum source, said vacuum source includes a manifold having a plurality of suction ports, at least one of said suction ports having a corresponding cover disposed within said manifold, said cover having a column extending downward from said cover through said suction port, said cover covering said suction port, said column configured to engage the stacked paper and in response to engagement with the stacked paper, said column lifts said cover to open said suction port.

7. A vacuum paper feeding device for image forming apparatus, comprising:

a paper supply table configured to be raised in response to paper consumption, said paper supply table having a front end and a rear end;

a blowing means for blowing air from a front end of papers staked on said paper supply table toward a rear end of the stacked papers; and a vacuum source and corresponding air permeable belts for moving and transferring an uppermost one of the stacked paper, said belts extending around a portion of said vacuum source, said vacuum source includes a manifold having a plurality of suction ports, at least one of said suction ports having a corresponding cover disposed within said manifold, said cover having a column extending downward from said cover through said suction port, said cover covering sand suction port, said column configured to engage the stacked paper and in response to engagement with the stacked paper, said column lifts said cover to open said suction port.

8. The vacuum paper feeding device as set forth in claim 7, wherein said manifold further comprises at least two groups of suction ports, a first group of suction ports being open and a second group of suction ports, each being provided with a corresponding one of said cover.

9. The vacuum paper feeding device as set forth in claim 7, wherein the vacuum paper feeding device further comprises:

a rear end urging plate extending above an upper surface of said paper supply table proximate said rear end thereof, said urging plate having an upper end having an inclined portion configured for engagement with the stacked papers urging the uppermost of the stacked papers toward said front end of said paper supply table, said urging plate being further formed with a curved portion which arcs from said inclined portion toward the stacked papers;

whereby air flow from said blowing means is directed by said inclined portion and said curved portion down toward an uppermost paper of the stacked papers in order to prevent further papers of the stacked papers from moving with movement of the uppermost paper.

10. The vacuum paper feeding device as set forth in claim 7, wherein:

wherein said paper supply table includes at least one rib formed which extends along an upper surface thereof for slightly lifting the stacked papers, said rib configured to allow air from said blowing means to flow between a bottom paper of the stacked paper and said upper surface of said paper supply table with said paper supply table in an upper position.

* * * * *